US009576469B2

(12) United States Patent
Modi et al.

(10) Patent No.: US 9,576,469 B2
(45) Date of Patent: Feb. 21, 2017

(54) SYSTEMS AND METHODS OF ADAPTIVELY ADJUSTING A SENSOR OF A SECURITY SYSTEM

(71) Applicant: Google Inc., Mountain View, CA (US)

(72) Inventors: Yash Modi, San Mateo, CA (US); Kevin Charles Peterson, San Francisco, CA (US); Mark Rajan Malhotra, San Mateo, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/585,301

(22) Filed: Dec. 30, 2014

(65) Prior Publication Data

US 2016/0189531 A1 Jun. 30, 2016

(51) Int. Cl.

| | |
|---|---|
| ***G08B 29/18*** | (2006.01) |
| ***G08B 13/08*** | (2006.01) |
| ***G08B 29/24*** | (2006.01) |

(52) U.S. Cl.

CPC ..... *G08B 29/185* (2013.01); *G08B 13/08* (2013.01); *G08B 29/188* (2013.01); *G08B 29/24* (2013.01)

(58) Field of Classification Search

CPC ..... G08B 25/009; G08B 29/185; G08B 13/00; G08B 13/04; G08B 13/08; G08B 13/1436; G08B 21/00; G08B 21/02; G08B 23/00; G08B 25/002; G08B 25/008; G08B 29/18; G08B 29/186; G08B 29/26; G08B 29/28

See application file for complete search history.

(56) References Cited

U.S. PATENT DOCUMENTS

| | | | | |
|---|---|---|---|---|
| 3,717,864 A | | 2/1973 | Cook et al. | |
| 4,333,093 A | * | 6/1982 | Raber | G08B 13/1654 340/528 |
| 4,845,464 A | | 7/1989 | Drori et al. | |

(Continued)

FOREIGN PATENT DOCUMENTS

| | | | |
|---|---|---|---|
| DE | 102013210747 | A1 | 12/2014 |
| EP | 1772833 | A1 | 4/2007 |
| FR | 2892517 | A1 | 4/2007 |

OTHER PUBLICATIONS

Invitation to Pay Additional Fees and Partial Search Report for PCT/US2015/067681 dated, Apr. 18, 2016, 9 pages.

(Continued)

*Primary Examiner* — Van Trieu
(74) *Attorney, Agent, or Firm* — Morris & Kamlay LLP

(57) ABSTRACT

Embodiments of the disclosed subject matter provide systems and methods of adaptively adjusting sensitivity of a sensor of a security system that provide a first sensor to detect a motion event of a door or window of a building, and a controller communicatively coupled to the first sensor, to determine whether the detected motion event is a human-caused motion event or a periodic motion event by a comparison between data of the detected motion event and stored motion data, and to generate a security exception when the detected motion event is determined to be a periodic motion event, where the controller adaptively adjusts a sensitivity of the first sensor to detect the motion event according to data aggregated by the first sensor over a predetermined period of time.

23 Claims, 6 Drawing Sheets

(56) References Cited

U.S. PATENT DOCUMENTS

| | | | | |
|---|---|---|---|---|
| 5,917,409 | A * | 6/1999 | Wang | G08B 29/24 340/506 |
| 5,936,522 | A * | 8/1999 | Vogt | G08B 13/08 340/501 |
| 6,737,972 | B1 | 5/2004 | Gitlis | |
| 7,187,282 | B2 * | 3/2007 | Fergusson | G01D 5/2405 340/13.2 |
| 8,144,010 | B2 * | 3/2012 | Smith | G08B 13/04 340/522 |
| 8,217,790 | B2 * | 7/2012 | Script | G01P 15/09 200/61.45 M |
| 9,208,676 | B2 * | 12/2015 | Fadell | G05B 19/042 |
| 2006/0028334 | A1 | 2/2006 | Adonailo et al. | |
| 2006/0055534 | A1 * | 3/2006 | Fergusson | G01D 5/2405 340/562 |
| 2007/0182540 | A1 | 8/2007 | Marman et al. | |
| 2008/0165001 | A1 | 7/2008 | Drake et al. | |
| 2010/0283607 | A1 * | 11/2010 | Smith | G08B 13/04 340/541 |
| 2010/0302025 | A1 * | 12/2010 | Script | G01P 15/09 340/539.1 |
| 2015/0022316 | A1 * | 1/2015 | Dixon | G08B 25/001 340/5.51 |

OTHER PUBLICATIONS

PCT/US2015/067681, International Search Report and Written Opinion issued in PCT/US2015/067681 on Jun. 27, 2016, Jun. 27, 2016, p. 19.

* cited by examiner

SYSTEMS AND METHODS OF ADAPTIVELY ADJUSTING A SENSOR OF A SECURITY SYSTEM

BACKGROUND

Current security system can include vibration sensors. Such sensors typically activate an alarm when the vibration sensor senses vibration, shaking, striking, and similar movement. These sensors typically have sensitivity levels that are set by a user. That is, the user must manually adjust a setting of the sensor, which may lead to the sensor activating an alarm for an event that the user does not wish to detect. For example, if the sensitivity of the vibration sensor is increased by the user, the sensor can activate the alarm when a vibration, shaking, striking, or similar event occurs which is unrelated to a security event. For example, when the vibration sensor is mounted to a window of a home or building, branches of a nearby tree knocking against the window, or rain, thunder, wind, or the like can activate the alarm. However, these detected vibrations are unrelated to a security event. If the sensitivity of the vibration sensor of a typical security system is decreased by the user, it is likely that the sensor will not detect a vibration, shaking, striking, or moving event that is part of a security event, and will not activate an alarm. This creates a safety and a security risk to the occupant of the home or building, as the occupant is not aware of the security event.

BRIEF SUMMARY

According to an embodiment of the disclosed subject matter, a system may provide a first sensor to detect a motion event of a door or window of a building, and a controller communicatively coupled to the first sensor, to determine whether the detected motion event is a human-caused motion event or a periodic motion event by a comparison between data of the detected motion event and stored motion data, and to generate a security exception when the detected motion event is determined to be a periodic motion event, where the controller adaptively adjusts a sensitivity of the first sensor to detect the motion event according to data aggregated by the first sensor over a predetermined period of time.

According to an embodiment of the disclosed subject matter, a method may be provided that includes detecting, by a first sensor, a motion event of a door or window of a building, determining, by a controller communicatively coupled to the first sensor, whether the detected motion event is a human-caused motion event or a periodic motion event by comparing data of the detected motion event and stored motion data, generating, by the controller, a security exception when the detected motion event is determined to be a periodic motion event, and adaptively adjusting, by the controller, a sensitivity of the first sensor to detect the motion event according to data aggregated by the first sensor over a predetermined period of time.

According to an embodiment of the disclosed subject matter, means for adaptively adjusting sensitivity of a sensor of a security system are provided that includes detecting, by a first sensor, a motion event of a door or window of a building, determining, by a controller communicatively coupled to the first sensor, whether the detected motion event is a human-caused motion event or a periodic motion event by comparing data of the detected motion event and stored motion data, generating, by the controller, a security exception when the detected motion event is determined to be a periodic motion event, and adaptively adjusting, by the controller, a sensitivity of the first sensor to detect the motion event according to data aggregated by the first sensor over a predetermined period of time.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
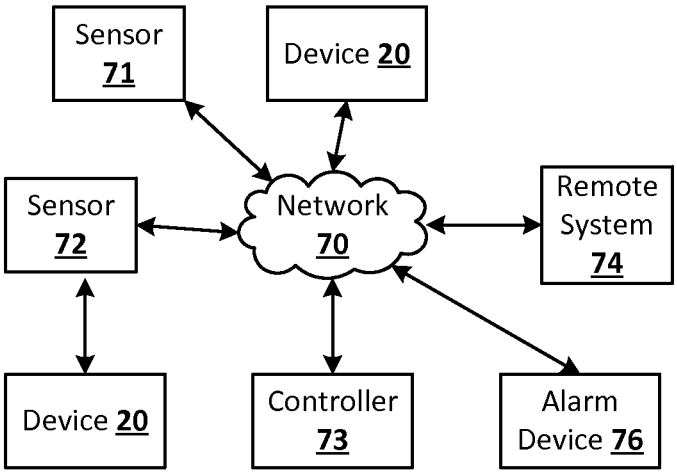
FIG. 1 shows a security system according to embodiments of the disclosed subject matter.

According to embodiments of the disclosed subject matter, sensors in a smart-home environment and/or a security system may distinguish between human-caused motion events, which may be a security event for which an alarm may be output and/or a notification message may be transmitted to a device, and motion events caused by other sources, such as vibration, shaking, striking, and/or moving (e.g., from rain, hail, ground vibration, sound waves, or the like), but for which the system may not output an alarm and/or transmit a notification message.

The sensors of the security system may be mounted on and/or disposed near, for example, a door or window in a home or building. The sensors may detect the movement of the door or window, such as when a person opens the door or window. To determine whether the movement of the window is a human-caused event, the sensors may include another sensor, such as a motion detector and/or camera to detect a movement path of a person towards the door or window, prior to the detection of the window being opened, and may detect the motion of the person as the person opens the door or window. For example, a camera may capture image data of the person prior to the detection of the door or window being opened, and may capture image data of the person as the person opens the door or window. That is, in some embodiments, data from sensors mounted so as to detect the opening of a door or window may be aggregated with motion and/or image data by the security system so as to determine that the opening of the door or window is a human-caused event.

The security system may determine whether the motion of a door or window is a human-caused event by calibrating the sensors to store and/or recognize typical movement and/or motion range of a door or window. For example, a "signature" of one or more motion events for a door or window may be determined for a particular sensor of the door or window. The signature motion events may characterize one or more human-caused motion events of the door or window. For example, the signature may include a complete and/or partial movement of an opening event of a door or window. The signature may include data such as a force applied, an acceleration, a range of directional change, a range of displacement of the door or window, and the like.

When the detected motion by the sensor on the door or window is determined to be different from the signature data, the security system may determine whether the detected motion is periodic or whether the motion is an intrusion event. That is, the data of the detected motion may be outside the range of force, acceleration, direction, and/or displacement of the signature data for the door or window. When the detected data that is different from the signature data is periodic (e.g., the motion, vibration, or the like is determined to repeat over a period of time), the security system may determine that the motion event is not a security event, and may generate a security exception so as to refrain from outputting an alarm and/or notification message. When the detected data is different from the signature data, and the detected data is non-periodic, the security system may determine that the motion event is a security event, and may output an alarm and/or transmit a notification message (e.g., to a smartphone, wearable computing device, or the like).

The sensors of the smart-home environment and security system may be adaptively adjusted. That is, the sensors may automatically adjust their sensitivity of detection or motion events. For example, motion event data detected by the door or window sensors may be aggregated over a period of time (e.g., one day, one week, one month, six months, one year, or the like), and the sensitivity of the door or window sensor may be adjusted according to the aggregated data. For example, if the home or building is located near a busy roadway with vehicle traffic that includes large trucks, buses, fire engines, and the like, the vibration detected by the sensors may be adjusted to account for the noise and/or vibration resulting from the vehicle traffic. That is, the sensitivity of the sensors may be adaptively adjusted, as data regarding non-human motion events is aggregated over time. The adaptive adjustment of the sensitivity of the sensors reduces the number of unwanted alarms (e.g., for motion events that are unrelated to human-caused motion). Moreover, this reduces the inconvenience in present security systems, where a user must manually adjust the sensitivity of the sensor, where increasing the sensitivity may cause unwanted alarm events and/or notifications, and decreasing the sensitivity may cause security and/or safety issues, as the sensor may be unable to accurately detect a security event.

In embodiments of the disclosed subject matter, a first sensor of the security system may be adaptively adjusted according to the adjustment and/or configuration of at least a second sensor (e.g., where the first and second sensors may be in a home or other building). In some embodiments, data from a plurality of sensors (e.g., the second sensor and the like) may be used to adaptively adjust the sensitivity of the first sensor. For example, the sensitivity of the second sensor may be set according to a greater number of data and/or data that has been aggregated over a longer period of time than the first sensor. That is, the sensitivity of the first sensor can be adjusted according to the settings of the second sensor, which may have increased accuracy (e.g., in distinguishing between periodic and non-periodic motion, vibration, and the like).

In the smart-home environment and security system, data from a plurality of sensors may be aggregated and analyzed by the system to determine whether the motion event is common to a plurality of sensors. For example, if a plurality of sensors detection a motion, vibration, and/or noise event within the same period of time, the system may generate a security exception so that the system may refrain from outputting an alarm and/or notification message. That is, the motion event that is detected by a plurality of sensors (e.g., a motion event common to the plurality of sensors) may be a non-human motion event, and thus may not be a security event. That is, if the home or building is located near a busy roadway, and fire truck with active sirens is moving at high speed on the roadway, the noise, motion, and/or vibration from the fire truck may be detected by a plurality of sensors of the home or building over the same time period. Thus, the system may generate a security exception according to the detection of similar motion data from a plurality of sensors over the same time period. In this example, although the fire truck may infrequently or randomly travel on the nearby road, the security system may determine that the noise, motion, and/or vibration is periodic (e.g., from the repeated sirens, the mechanical nature of the vibration, noise from the engine, or the like).

In some embodiments, the security system may generate a security exception when the movement of the door or window is determined to be a human-caused event. For example, the security system may generate a security exception when it is determined that the window or door is opened from the inside of the home or building. As the opening is from the inside, the opening may be performed by one of the occupants, and the security exception can be generated so that an alarm and/or notification message is refrained from being output. That is, unwanted alarms and/or notifications are minimized.

The security system may generate a security exception when a door or window is opened according to the operation mode of the security system. As discussed in detail below, the system may include operating modes such a "home" mode, an "away" mode, a "stay" mode, a "vacation" mode, a "transition" mode, or the like. For example, when the security system is operating in a "home" mode in which it is presumed that at least one occupant is present in the home, and one or more occupants of the home or building are actively moving about the home or building, the security system may generate a security exception when a door or window is opened from inside of the home or building (e.g., by the occupants). In another example, when the security system is operating in an "away" mode, where there are no occupants within the home or building, a security exception may not be generated by the system when a door or window is being opened, unless the person opening the door or window is determined to be an authorized user (e.g., an owner of the home that has returned and is attempting to enter the home).

In embodiments of the disclosed subject matter, the security system may determine whether the detected motion, vibration, and/or noise is from other, non-human sources. Sensors disposed on or near a door and/or window of a home may detect vibration, shaking, striking, and/or movement of the door or window. The system may determine whether the detected motion is periodic, so as to determine that the motion is from other, non-human sources. That is, the security system may determine whether the vibration, shaking, striking, and/or movement is, for example, repeated over a predetermined period of time. When the motion is determined to be periodic, the security system may generate a security exception, so as to refrain from outputting an alarm and/or notification message to a device (e.g., a smartphone, wearable computing device, or the like).

The security system and/or smart-home environment disclosed herein may have a plurality of operation modes in which it may operate (e.g., a home mode, an away mode, a stay mode, a vacation mode, and the like). As briefly discussed above, and as discussed in detail below, the operation mode of the security system may be considered when determining whether to generate a security exception when a motion event is detected. That is, the operation mode, the type of detected motion (e.g., whether the motion is from a human or another source), and whether motion is detected within the home or building may be used to determine whether the security system generates a security exception.

When the security system is set so as to operate in a stay mode, the system may assume and/or determine using the sensors 71, 72 of FIG. 1 that the home or building is occupied, and thus the security system may operate the sensors 71, 72 to detect an internal and/or external opening event of a door or window. The controller (e.g., the controller 73, the remote system 74, and/or the alarm device 76 of FIG. 1) may be set to distinguish between events such as a home occupant opening a window at night, an intruder event (e.g., forced entry through a door or window of the home), and/or other vibration and/or motion on the door or window (e.g., periodic motion and/or vibration, from wind, rain, vehicle traffic near the home or building, and the like). The sensors 71, 72 may be set to distinguish between the internal opening and closing of a door or window (e.g., which may be by an occupant of the home or building), an external opening of the door or window (e.g., which may be by an intruder), and/or periodic motion and/or vibration on the door or window. If the sensors 71, 72 determine that a particular room of the home or building is not occupied, the controller (e.g., the controller 73, the remote system 74, and/or the alarm device 76) may have a decreased error rate in detecting and/or distinguishing between internal and external opening events on a door or window.

When the security system is operating in the stay mode, the sensors 71, 72, which may be monitoring a door or window, may detect motion, vibration, and/or noise. The system may determine whether the motion, vibration, and/or noise is periodic, and, if so, the system generates a security exception, so that the system refrains from outputting an alarm and/or a notification message. In the stay mode, when the security system determines that the motion, vibration, and/or noise is non-periodic, the system may output an alarm and/or notification message. As discussed throughout, although one sensor may be used to detect the motion, noise, and or vibration, this detection may be corroborated with the data detected from other sensors in the home or building. When the system determines that other sensors have detected a similar motion, vibration, and/or noise event in the same time period, the system may determine that the motion event is not a human-caused motion event, and may generate the security exception, as described above.

When the sensors 71, 72 of a home or building detect the presence of an occupant in a room while the security system is in the stay mode, the controller (e.g., the controller 73, the remote system 74, and/or the alarm device 76) may reduce the amount of missed detections of intruder events or unwanted activations. That is, by using a plurality of sensors to track the movement of the occupant in a room, and by aggregating the detected movement events with the detected door or window events, the system may more accurately detect intruders and minimize unwanted alarms and/or notifications. The security system may also reduce the number of unwanted alarms output by the alarm device 76 and/or notification messages that are transmitted by determining whether the detected motion and/or vibration is periodic. That is, detected motion and/or vibration that is determined to be periodic may not be a security event (e.g., an attempted entry by an intruder), and a security exception may be generated so that the security system refrains from outputting an alarm and/or notification message. In some embodiments, when an occupant is detected within a room, but amount of movement from the occupant is below a threshold level, the controller may rely upon the events detected by the sensors 71, 72 mounted on and/or near the window to determine an opening event. In this example, the sensors 71, 72 may determine whether the movement and/or vibration is periodic so as to increase the accuracy of detecting a security event with the door or window sensors.

In some embodiments, motion detected in a room may be correlated with the motion detected by a sensor on a window. For example, play activities of children in a room may be detected by sensors in the room and on the window. This room sensor data may be used to correlate the motion in the room with the motion, vibration, or the like which is detected by the window sensor. That is, the sensed data may be non-periodic, but as the system correlates detected room motion with the motion detected by the window sensor, a security exception may be generated.

When the security system is set so as to operate in a home mode, the system may assume and/or determine using, for example, the sensors 71, 72 of FIG. 1, that the home or building is occupied. The home mode may be set by the security system, for example, during the daytime, when occupants may be actively moving about the home or building. As described above, the security system may distinguish between human-caused motion and other detected motion, and where the motion determined to be human motion is coming from (e.g., inside or outside of the home or building). When it is determined that the motion of the door or window is human-caused motion from inside of the home or building, the system may generate a security exception, and the system may refrain from outputting an alarm and/or notification message.

The security system may operate the sensors 71, 72 to detect an internal and/or external opening event of a door or window. The controller (e.g., the controller 73, the remote system 74, and/or the alarm device 76 of FIG. 1) may be set to distinguish between events such as a home occupant opening a window, periodic vibration and/or motion (e.g., from noise, rain, wind, vehicle traffic near the home or building, or the like), and an intruder event (e.g., forced entry through a door or window of the home).

When the security system is operating in the home mode, the sensors 71, 72 which may be monitoring a door or window, may detect motion, vibration, and/or noise. The system may determine whether the motion, vibration, and/or noise is periodic, and, if so, the system generates a security exception, so that the system refrains from outputting an alarm and/or a notification message. In the home mode, when the security system determines that the motion, vibration, and/or noise is non-periodic, the system may output an alarm and/or notification message. As discussed throughout, although one sensor may be used to detect the motion, noise, and or vibration, this detection may be corroborated with the data detected from other sensors in the home or building. When the system determines that other sensors have detected a similar motion, vibration, and/or noise event in the same time period, the system may determine that the motion event is not a human-caused motion event, and may generate the security exception, as described above.

In some embodiments, the security system may change the operation mode. The controller 73, device 20, and/or remote system 74 shown in FIG. 1 may receive input from a user and/or occupant to change a mode of operation of the security system. Alternatively, or in addition, the security system may determine, using the sensors 71, 72 of FIG. 1, whether the home or building is occupied, and/or whether the occupants are actively moving about the home or building, and change the operation mode accordingly (e.g., to a home mode when occupants are actively moving about, and a stay mode when there is less activity from occupants, such as at night). The system may also determine when there are no occupants to the home or building, and change the operation mode accordingly (e.g., change to an away mode or a vacation mode).

Figure 5:
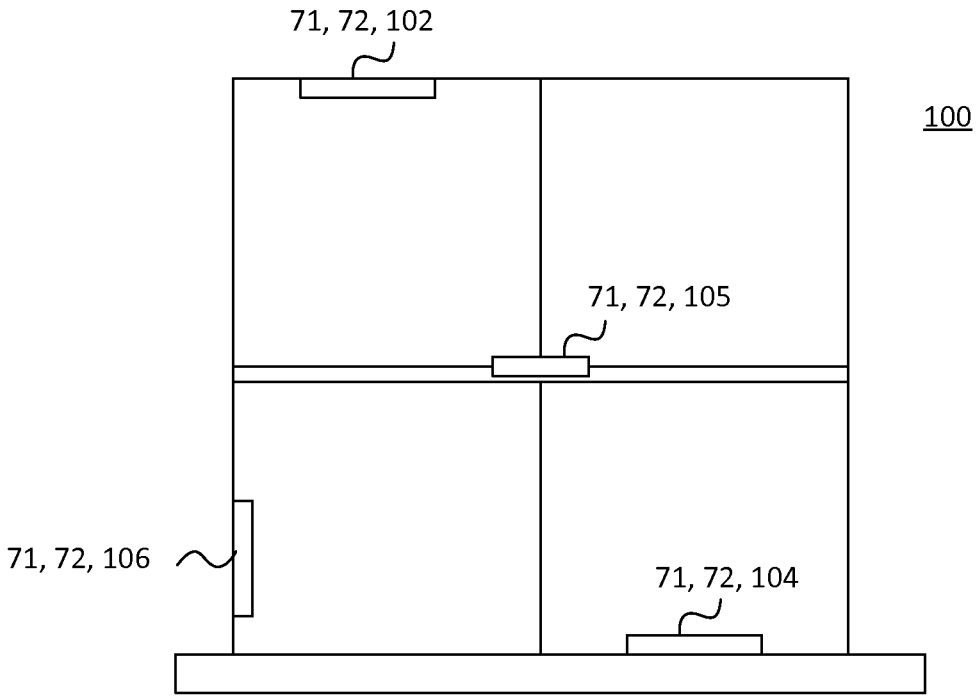
FIG. 5 show example positions of window sensors according to embodiments of the disclosed subject matter.

FIG. 5 shows example positions of window sensors according to embodiments of the disclosed subject matter. The window sensors shown in FIG. 5 may detect motion, vibration, noise, or the like. The sensors may determine whether a window is being opened, and whether the opening is from the inside or the outside of the home or building. In some embodiments, the window sensors shown in FIG. 5 may be used in combination with a camera sensor and/or a communication interface to determine the identity of the person opening the window (e.g., from image data captured from the person and/or identifying information from a device carried by the person). Such sensors may be disposed on the inside and/or outside of the window, or within a predetermined proximity to the window, on the inside and/or outside of the home or building having the window. That is, the camera and/or communication sensors may acquire images and/or data from a variety of suitable positions near the window. To more accurately detect the opening of a window, and the side (e.g., inside or outside) that the window is being open, FIG. 5 show examples of a different types and mounting locations of sensors to determine the opening of the window from the inside or outside.

The type, number, position, and/or adjustment (e.g., sensitivity adjustment, configuration, and the like) of the sensors may be so as to detect a human-caused event, such as opening a window from the inside (e.g., by a home occupant) or the outside (e.g., by an intruder). The one or more sensors 71, 72 may be mounted in one or more positions relative to the window 100. As shown in FIG. 5, the sensors 71, 72 in position 102, may be mounted in a vertical position, so as to be facing downward. The sensors 71, 72 may be mounted in position 104 in a vertical position as to be facing upward. The sensors 71, 72 in position 106 may be mounted in a horizontal position. The sensors 71, 72 may be mounted in position 105 to monitor a lock on the window 100. One of more of the sensors 71, 2 may be mounted in positions 102, 104, 105, and 106 to determine whether the opening of the window 100 is from inside the home or building, or from the outside. Although sensors 71, 72 are shown as mounted in positions 102, 104, 105, and 106 in FIG. 5, these are merely examples of the number of sensors and mounting positions for the window 100 that may be used. For example, one sensor may be mounted (e.g., mounted in position 106), or two sensors may be mounted, such as in positions 104 and 106.

For example, the sensors 71, 72, which may include an electronic compass, an accelerometer, and/or a reed switch, may be used to detect the opening of the window by a human-caused event. That is, the accelerometer may detect the motion of the window when opened by a person (e.g., from a closed state). For example, if the window is of a type that swings outward to open, the electronic compass may determine the change in angle of the window as it opens. The reed switch may detect a break in a magnetic field from a closed position of the window, thus indicating that a human-caused event has moved the window.

In FIG. 5, the sensors 71, 72 may be positioned, and/or selected according to type, and/or may be increased in number so as to detect how a home occupant opens the window from the inside. For example, the number, type, and position of the sensors may be selected so as to detect different speeds of an approach of a person to open the window. For example, some sensors may not be able to accurately detect a speed of movement above a predetermined level (e.g., a fast movement path to open a window). Accordingly, one or more sensors 71, 72 may be selected to detect different speeds of approach by a person to open a window. The sensors 71, 72 may also be able to detect a pause or stop in movement by the person in the approach to open a window. The approach by a person to open the window may include an angle and/or a path, where the path may be straight, curved, radial, and/or from a side. As discussed throughout, the detected speed of movement and the approach may be compared to signature data for a sensor for a window (e.g., where the signature data includes data for the force of opening, the range of movement, and data regarding an approach to the window). When at least a portion of the detected data and the signature data are the same, the system may generate a security exception to refrain from outputting an alarm and/or notification message.

The sensors 71,72 may be adjusted, calibrated, and/or configured to distinguish motion from the human-caused events and other vibration, noise, and motion detected by the sensors 71, 72. For example, the sensors may be configured, calibrated, and/or adjusted to determine periodicity of the detected noise, vibration, and/or motion. That is, the sensors 71, 72 may determine whether the detected data is repeated over a period of time. For example, vibration from rain or hail contacting the window and being detected by the sensor may be determined to be periodic, and thus the system may not activate the alarm 76 to output a visual and/or audible alarm. That is, when the motion, vibration, and/or noise is determined to be periodic, the system may generate a security exception. In another example, noise and/or vibrations from vehicle traffic from road nearby the home or building may be sensed by the sensors 71, 72. The noise and/or vibrations from the flow of vehicle traffic on the road over a period of time may be determined by the sensor to be periodic, and thus the system may generate a security exception.

For example, the system may adjust the sensors such that weather events (e.g., wind, rain, hail, or the like) may be determined to be periodic, and thus the system may generate a security exception. Although a default signature and/or profile may be used by the system to determine that the detected data from the sensors 71, 72 is rain, hail, or the like (e.g., the system compares the detected data with the pre-stored signature and/or profile data), the characteristics of rain, hail, or the like may change during a particular weather event (e.g., light rain or hail on the window at the beginning of a weather event, with increasing force and timing of impact as the weather event progresses). That is, the system may determine that although the initial detection of the force of the rain, hail, or the like is not repeated with the same time intervals (e.g., where force of the rain or hail detected by the sensors 71, 72 may not have the same time intervals), the force detected from the rain or hail may be re-occurring. The system may adjust the pre-stored profile and/or sensitivity of the sensors 71, 72 so that it may account for the increase in force and/or periodicity of the rain or hail (e.g., as the storm increases in intensity), and/or adjust the pre-stored profile and/or sensitivity of the sensors 71, 72 to account for the decrease in force and periodicity of the rain or hail (e.g., as the storm decreases in intensity). Due to size of some hail, which may be larger and impart a greater force detected by the sensors 71, 72 during the storm, the larger hail may be determined by the system to be part of the re-occurring force being detected by the sensors over a time period. That is, the system may adjust and/or update the pre-stored signature and/or profile to change the range of force that a weather event may have (e.g., so as to include the force detected by the larger hail). In some embodiments, where the detected force of the rain or hail is outside the pre-stored range of force, the system may transmit a notification to a user's device (e.g., smartphone, wearable computing device, or the like), with an option to launch an application so that the sensors 71, 72 may capture images and/or video that may be presented to the user. This may either reassure the user that the event is weather-related, or inform the user that the event is non-weather related, and may be a security threat. The application may allow the user to generate a security exception, and/or may allow the user to output of an audio and/or visual alarm, and/or notify a home security provider and/or law enforcement. The system may provide reassurance to the user that the event is weather-related by reporting in the notification that a plurality of window sensors (e.g., throughout the home) are detecting similar events, and thus may likely be a weather event.

In another example, the system may adjust the sensors such that vehicle traffic events from a nearby roadway to the home or building (e.g., movement of large trucks and/or fire engines at speed, sirens from emergency vehicles, noise from car and/or motorcycle without a muffler or with an exhaust output with enhance noise, or the like) may be determined to be periodic, and thus the system may generate a security exception. Although a default signature and/or profile may be used by the system to determine that the detected data from the sensors 71, 72 is vehicle traffic (e.g., the system compares the detected data with the pre-stored signature and/or profile data), the characteristics of vehicle traffic or the like may change over the course of a day (e.g., traffic noise may increase between the hours of 7 AM-10 AM and from 4 PM-7 PM during weekdays, and may be different during weekend days, where it may not have the same pattern as on weekdays). That is, the system may determine the time intervals of the day in which the noise and/or vibration from the traffic may increase and cause vibration on the window 100, which may be ongoing and/or repeated, with different levels of detected force. When the system determines time periods (e.g., 7 AM-10 AM and from 4 PM-7 PM during weekdays) during which the frequency and magnitude of the noise and/or vibration may increase, the system may decrease the sensitivity of the sensors for this time period, and/or may adjust the system to generate security exceptions for the time periods when this noise and/or vibration occurs. The system may adjust the pre-stored profile and sensitivity of the sensors 71, 72 so that it may account for the increase in noise, vibration, and/or periodicity of the vehicle traffic (e.g., as the amount of traffic increases, as the number of trucks increases, or the like), and/or adjusts the pre-stored profile and sensitivity of the sensors 71, 72 to account for the decrease in noise and/or vibration (e.g., as the traffic decreases at night, late morning, or the like). Some traffic noise, such as sirens from emergency vehicles, may infrequently occur, and/or may occur at different times of the day (e.g., where there is no standard pattern of occurrence). The pre-stored signature and/or profile of the system may account for the noise and/or vibration profile of sirens, whose repetitive sound and/or vibration profile may be detected, and the system may generate a security exception. In some embodiments, where the detected noise and/or vibration of the traffic is outside the pre-stored ranges, the system may transmit a notification to a user's device (e.g., smartphone, wearable computing device, or the like), with an option to launch an application so that the sensors 71, 72 may capture images and/or video that may be presented to the user. This may either reassure the user that the event is traffic-related, or inform them that the event is non-weather related, and may cause a security threat. The application may allow a user to generate a security exception, and/or may allow the user to output of an audio and/or visual alarm, and/or notify a home security provider and/or law enforcement. The system may provide reassurance to the user that the event is traffic-related by reporting in the notification that a plurality of window sensors (e.g., throughout the home) are detecting similar events, and thus may likely be a traffic event. In some embodiments, when the noise, vibration, and/or force is detected by a plurality of sensors 71, 72 disposed on or near multiple windows 100 of the home or building, the system may determine that the event is a non-security event, and may generate a security exception. As the noise, vibration, and/or force is detected by sensors 71, 72 for multiple windows, the system may refrain from adjusting the sensitivity of the sensors 71, 72 for the windows 100.

As there may be a plurality of windows in a room, home, or building, which may have sensors, the security system may aggregate the data from the plurality of sensors to determine whether the detected motion, noise, and/or vibration is similarly detected among two or more of the sensors for a period of time. If a plurality of window sensors (e.g., on different windows in the same room, home, or building) detect similar motion, the system may generate a security exception, and thus may refrain from outputting an alarm and/or notification message. For example, multiple windows may detect rain as periodic vibration. A system as disclosed herein may determine that similar periodic vibrations have been detected by multiple windows on different sides of a building, and thus determine that the periodic motion corresponds to an external non-human-caused event.

In FIG. 5, the types of windows on which sensors 71, 72 may be mounted may include vertical sliding, horizontal sliding, casement, horizontal pivot, vertical pivot, transom, awning windows, and the like. The windows may have locks, which may be in a locked or unlocked state, which may be determined by the sensors 71, 72. The windows may be detected by the sensors 71, 72 as open, closed, or partially open.

The sensors 71, 72 of the window 100 may be calibrated so as to detect a signature motion of the window. Calibration may include setting the sensitivity of the sensor to detect motion. For example, the sensors 71, 72 may be calibrated to detect a typical force, acceleration, and range of motion of the window 100 (e.g., for an opening operation) to generate signature motion characteristics for the window. When the sensors detect motion, vibration, and/or noise that is not included in the signature motion, the system may then determine whether the motion is human-caused motion or not. For example, image data and/or motion data may be captured by sensors disposed adjacent to the window so as to capture image and/or motion data of a person generating a motion event on the window. If the motion is from outside of the window, the security system may active an alarm and/or transmit a notification message. When the motion is determined so as not to be included in the signature, but the motion is determined to be periodic, the security system may generate a security exception so as to refrain from outputting an alarm and/or transmitting a notification message.

In embodiments of the disclosed subject matter, the calibration and/or sensitivity of the sensors 71, 72 may be adaptively adjusted as more data is captured by the sensors over time. For example, the sensors 71, 72 may more accurately detect periodic motion, as the motion profiles of the detected motion may be repeated over time. In some embodiments, calibration and/or sensitivity data from a second sensor, or a plurality of sensors, may be used to adaptively adjust a first sensor. For example, the calibration and/or sensitivity of the second sensor may be based on a larger dataset, and thus may be more accurate in detecting periodic motion and/or human motion events. The calibration and/or sensitivity of the first sensor may be adjusted based on the calibration and/or sensitivity data of a second sensor. The adaptive adjustment of the sensors may reduce unwanted alarm events, any may increase the accuracy of classifying detected motion data as periodic or human-caused motion.

Figure 6:
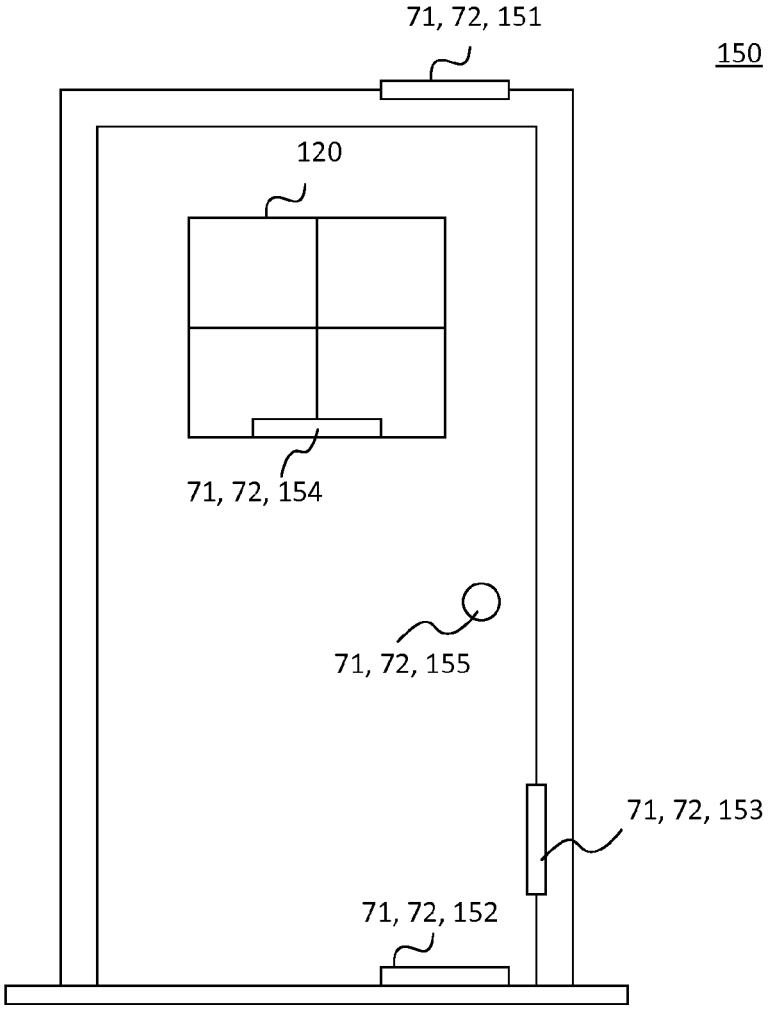
FIG. 6 shows example positions of door sensors according to an embodiment of the disclosed subject matter.

FIG. 6 shows example positions of door sensors according to an embodiment of the disclosed subject matter. The door sensors shown in FIG. 6 may detect motion, vibration, and/or noise. The sensors may determine whether a door is being opened, and whether the opening is from the inside or the outside of the home or building. In some embodiments, the door sensors shown in FIG. 6 may be used in combination with a camera sensor and/or a communication interface to determine the identity of the person opening the door (e.g., from image data captured from the person and/or identifying information from a device carried by the person). Such sensors may be disposed on the inside and/or outside of the door, or within a predetermined proximity to the door, on the inside and/or outside of the home or building having the door. That is, the camera and/or communication sensors may acquire images and/or data from a variety of suitable positions near the door. To more accurately detect the opening of a door, and the side (e.g., inside or outside) that the door is being open, FIG. 6 show examples of a different types and mounting locations of sensors to determine the opening of the door from the inside or outside.

As similarly discussed above in connection with FIG. 5, the type, number, position, and/or adjustment (e.g., sensitivity adjustment, configuration, and the like) of the sensors may be selected and/or configured so as to detect a human-caused event, such as opening a door from the inside (e.g., by a home occupant) or the outside (e.g., by an intruder). Sensors 71, 72 maybe mounted on and/or adjacent to door 150. For example, as shown in FIG. 6, sensors 71, 72 may be mounted in position 151, 152, and/or 153. That is, the sensors 71, 72 may be mounted in a vertical position 151 that is a downward-facing position. Alternatively, or in addition, the sensors 71, 72 may be mounted in a vertical position 152 that is an upward-facing position. Alternatively, or in addition, the sensors 71, 72 may be mounted in a horizontal position 153.

As discussed above in connection with the sensors 71, 72 disposed on or near the window 100, the sensors 71, 72 for the door 150 may be similarly adjusted to account for weather events (e.g., wind, rain, hail, and the like), traffic conditions, and the like.

For example, the sensors 71, 72 on the door may include an electronic compass, an accelerometer, and/or a reed switch to detect the opening of the door by a human-caused event. That is, the accelerometer may detect the motion of the door when opened by a person (e.g., from a closed state), and the electronic compass may determine the change in angle of the door as it opens. The reed switch may detect a break in a magnetic field from a closed position of the door, thus indicating that a human-caused event has moved the door.

As shown in FIG. 6, the sensors 71, 72 may be mounted in position 155 to determine whether a door handle of the door 150 is turned and/or moved, and/or a lock of the door 150 is moved from a locked position to an unlocked position. The door 150 may include a window 120. For example, the window 120 of door 150 may not be openable. However, as shown in FIG. 6, the sensors 71, 72 may be mounted at position 154 to determine an intrusion event, such as the breaking of the window 120. Although sensors 71, 72 as shown in FIG. 6 as being mounted in positions 151, 152, 153, 154, and/or 155, these are merely example mounting positions, and the sensors 71, 72 may be mounted in any suitable locations for sensors 71, 72 are shown in FIG. 6, the door 150 may have one or more sensors to detect and opening event and/or an intrusion event. That is, the security system disclosed herein is not limited to the number of sensors shown in FIG. 6.

In FIG. 6, the sensors 71, 72 may be positioned, and/or selected according to type, and/or may be increased in number so as to detect the movement of a door as human-related event. For example, the number, type, and position of the sensors should be selected so as to detect different speeds of an approach of a person to open the door. For example, some sensors may not be able to accurately detect a speed of movement above a predetermined level (e.g., a fast movement path to open a door). Accordingly, one or more sensors 71, 72 may be selected to detect different speeds of approach by a person to open a door. The sensors 71, 72 may also be able to detect a pause or stop in movement by the person in the approach to open a door. The approach by a person to open the door may include an angle and a path, where the path may be straight, curved, radial, and/or from a side. As discussed throughout, the detected speed of movement and the approach may be compared to signature data for a sensor for a door (e.g., where the signature data includes data for the force of opening, the range of movement, and data regarding an approach to the door). When at least a portion of the detected data and the signature data are the same, the system may generate a security exception to refrain from outputting an alarm and/or notification message.

The sensors may be adjusted, calibrated, and/or configured to distinguish between a human-related event and another motion event. For example, the sensors 71, 72 may distinguish between vibration caused by an intruder attempting to force entry through the door 150, and periodic vibration. For example, the sensors 71, 72 may detect movement and/or vibration from wind, which may move the door, and which may be periodic over a period of time. In another example, vehicle traffic (e.g., trucks, buses, cars, etc.) on a road nearby the home or building may create vibration which may be detected by the sensors 71, 72. When the system determines that the vibration is periodic, the system may generate a security exception, where the system may refrain from outputting an alarm and/or a notification message.

In FIG. 6, the types of doors in which sensors 71, 72 may be mounted on may include sliding, French, double, single, pocket, storm, windowed doors, and the like. The doors may have locks, which may be in a locked or unlocked state, which may be determined by the sensors 71, 72. The sensors 71, 72 may also detect the movement of a door handle. The doors may be detected by the sensors 71, 72 as open, closed, or partially open. The door handle may be a smart door handle, which may detect when force is exerted on it, from either an occupant or from an intruder (e.g., who is attempting to enter from outside the door).

As similarly described above in connection with calibrating the sensors in FIG. 5 that are disposed on windows, the sensors 71, 72 of the door 150 may be calibrated so as to detect a signature motion of the door. Calibration may include setting the sensitivity of the sensor to detect motion. For example, the sensors 71, 72 may be calibrated to detect a typical force, acceleration, and range of motion of the door 150 to generate signature motion characteristics for the door. When the sensors detect motion, vibration, and/or noise that is not included in the signature motion, the system may then determine whether the motion is human-caused motion or not. For example, image data and/or motion data may be captured by sensors disposed adjacent to a door (e.g., a door that leads outside the home or building) so as to capture image and/or motion data of a person generating a motion event on the door. When the motion is from outside of the door, the security system may activate an alarm and/or transmit a notification message. When the motion is determined so as not to be included in the signature data, but the motion is determined to be periodic, the security system may generate a security exception so as to refrain from outputting an alarm and/or transmitting a notification message.

In embodiments of the disclosed subject matter, the calibration and/or sensitivity of the sensors 71, 72 for the door 150 may be adaptively adjusted as more data is captured by the sensors over time. For example, the sensors 71, 72 for the door 150 may, over time, more accurately detect periodic motion (e.g., as the motion profiles of the detected motion may repeat over time). In some embodiments, calibration and/or sensitivity data from a second sensor, or a plurality of sensors, may be used to adaptively adjust a first sensor of the door 150. For example, the calibration and/or sensitivity of the second sensor may be based on a larger dataset, and thus may be more accurate in detecting periodic motion and/or human motion events on the door 150. The calibration and/or sensitivity of the first sensor may be adjusted based on the calibration and/or sensitivity data of a second sensor. The adaptive adjustment of the sensors may reduce unwanted alarm events related to the door 150, any may increase the accuracy of classifying detected motion data as periodic or human-caused motion.

As discussed above in connection with the calibration and/or sensitivity of the sensors 71, 72 for the window 100, the sensors 71, 72 for the door 150 may be adaptively adjusted as more data is captured by the sensors 71, 72 over time. As discussed above, the sensors 71, 72 may be similarly adjusted to account for weather events (e.g., wind, rain, hail, and the like), traffic conditions, and the like.

Figure 7A:
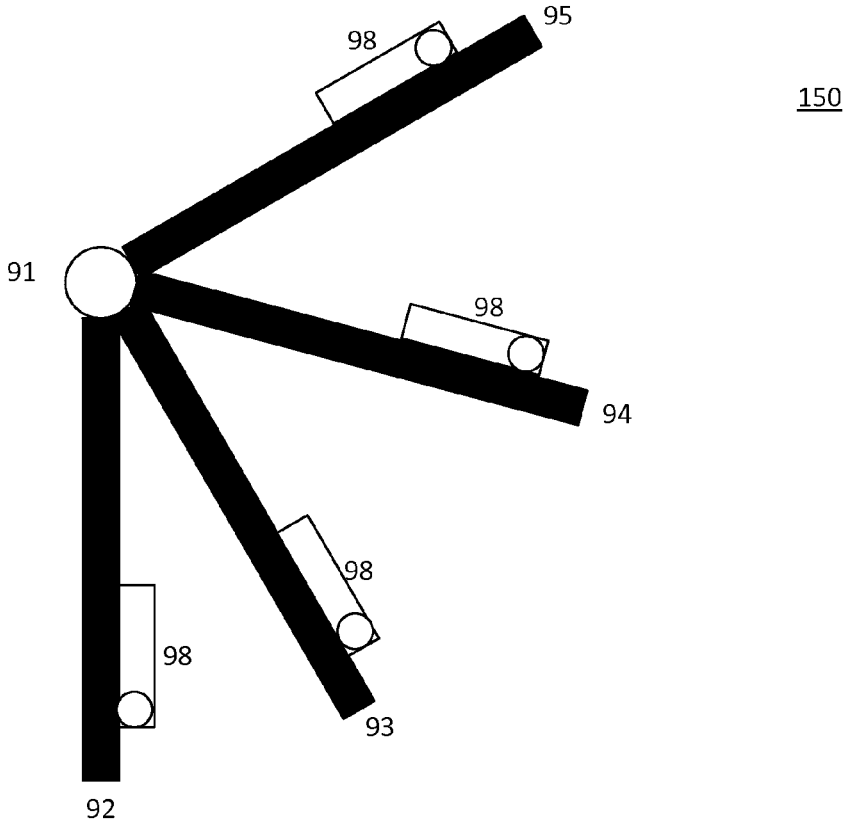
FIGS. 7A-7B show example sensors according to an embodiment of the disclosed subject matter.
Figure 7B:
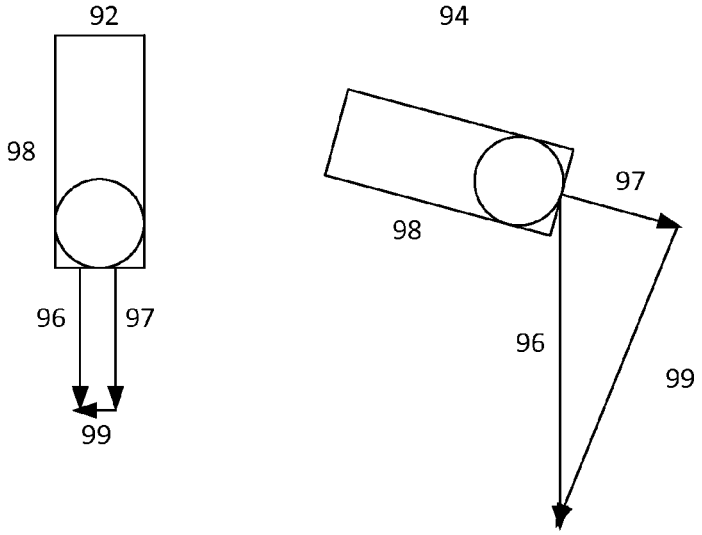

Further to the example mounting positions for sensors 71, 72 for door 150 shown in FIG. 6, FIGS. 7A-7B show an example sensor 98 that can be mounted to the door 150. The sensor and its position as shown in FIGS. 7A-7B may be used to determine whether the door is being opened, and from which side the door is opened (e.g., the inside or the outside). The sensor 98 may include an accelerometer and/or electronic compass which may detect movement and acceleration data, and may be used by the security system to determine whether the door is being open from the inside or the outside. The sensor 98 may be adaptively adjusted and/or calibrated in a similar manner to the sensors 71, 72 described above in connection with FIG. 6. That is, signature motion data for the door 150 may be determined using the sensor 98, and the sensor may be adaptively adjusted using data from other door sensors.

FIGS. 7A-7B show that the sensor 98 can be mounted to the door 150 (e.g., where door 150 is shown in detail in FIG. 6 and described above). For example, the security system of the disclosed subject matter may employ a magnetometer affixed to a door jamb and a magnet affixed to the door. When the door is closed, the magnetometer may detect the magnetic field emanating from the magnet. If the door 150 is opened (e.g., an opening event), the increased distance may cause the magnetic field near the magnetometer to be too weak to be detected by the magnetometer. If the security system (e.g., alarm device 76 shown in FIG. 1) is activated (e.g., operating in a home mode, a stay mode, or away mode), it may interpret such non-detection as the door 150 being ajar or open. In some configurations, a separate sensor or a sensor integrated into one or more of the magnetometer and/or magnet may be incorporated to provide data regarding the status of the door. For example, an accelerometer and/or an electronic compass may be included in sensor 98, which is affixed to the door and indicate the status of the door and/or augment the data provided by the magnetometer.

FIG. 7A shows a schematic representation of an example of the door 150 that opens by a hinge mechanism 91. In the first position 92, the door is closed and the sensor 98 may indicate a first direction. The door may be opened at a variety of positions as shown 93, 94, 95. The fourth position 95 may represent the maximum amount the door can be opened. Based on the sensor 98 readings, the position of the door may be determined and/or distinguished more specifically than merely open or closed. In the second position 93, for example, the door may not be far enough apart for a person to enter the home. A compass or similar sensor may be used in conjunction with a magnet, such as to more precisely determine a distance from the magnet, or it may be used alone and provide environmental information based on the ambient magnetic field, as with a conventional compass.

FIG. 7B shows a sensor 98 in two different positions, 92, 94, from FIG. 7A. In the first position 92, the electronic compass of the sensor 98 detects a first direction 96. The electronic compass's direction is indicated as 97 and it may be a known distance from a particular location. For example, when affixed to a door, the sensor 98 may automatically determine the distance from the door jamb or a user may input a distance from the doorjamb. The distance representing how far away from the door jamb the door is 99 may be computed by a variety of trigonometric formulas. In the first position 92, the door is indicated as not being separate from the door jamb (i.e., closed) 99. Although features 96 and 97 are shown as distinct in FIG. 7B, they may overlap entirely.

In the second position 94, the distance between the door jamb and the door 99 may indicate that the door has been opened wide enough that a person may enter.

In some configurations, an accelerometer may be employed (e.g., as a part of sensor 98) to indicate how quickly the door is moving. For example, the door may be lightly moving due to a breeze. This may be contrasted with a rapid movement due to a person swinging the door open. The data generated by the compass, accelerometer, and/or magnetometer may be analyzed and/or provided to a central system such as a controller 73 and/or remote system 74 as described in connection with FIGS. 1 and 4. The data may be analyzed to learn a user behavior, an environment state, and/or as a component of a home security, a home automation system, and/or the smart-home environment. The data may also be aggregated with other sensor data to determine whether the door is being opened, whether the door is being opened from the inside or the outside, and/or the identity of the person opening the door. The security system may generate a security exception (e.g., in which an alarm may not be output and/or a notification message may not be transmitted) according to the mode of the security system, whether the door is being opened from the inside or outside, and the identity of the person opening the door.

Data generated by one or more sensors (e.g., sensors 71, 72 and/or 98 discussed above) may indicate patterns in the behavior of one or more users and/or an environment state over time, and thus may be used to "learn" characteristics of the movement of occupants in a home or building, their use of doors or windows, the speed and path of approach of occupants for an opening event, periodic noise, motion, and vibration, and the like to increase the successful detection of opening events and minimize false activations of the alarm device. This learned data may be aggregated, and may be used by the security system to generate a security exception, where a pattern of movement in opening a door or window is recognized as being that of a registered used (e.g., an occupant of the home). As discussed throughout, when a security exception is generated, the system may refrain from outputting an alarm and/or notification message.

Figure 8:
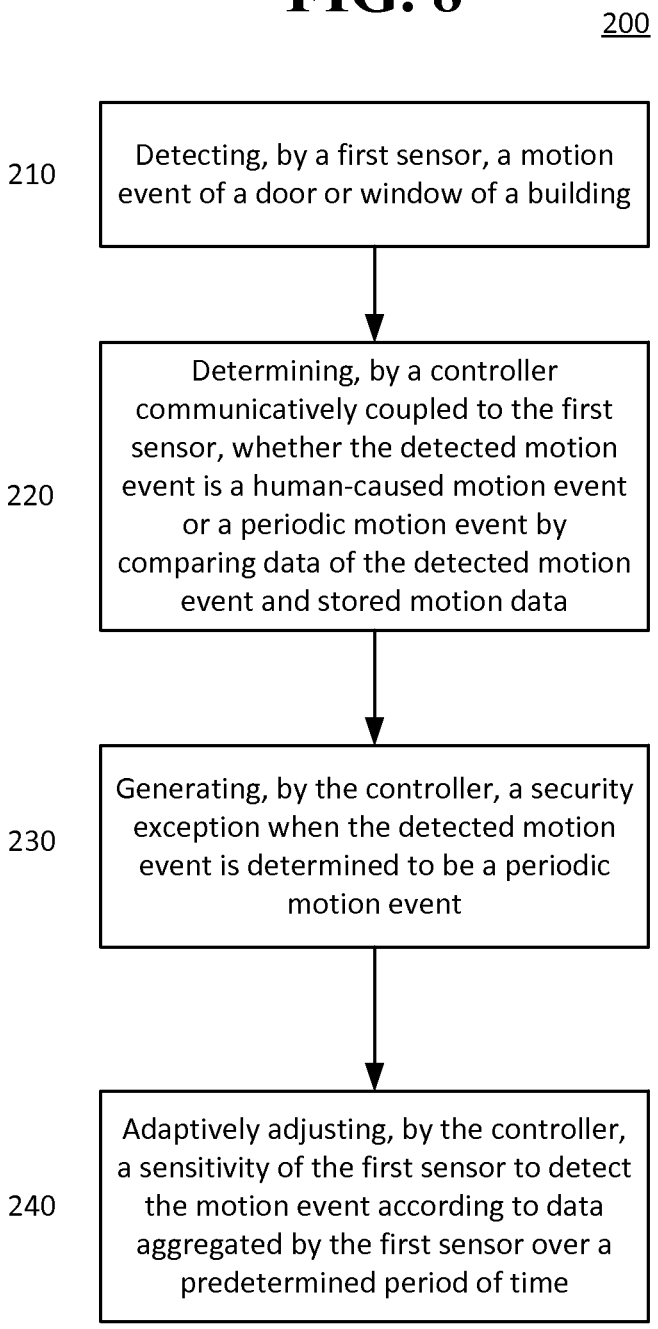
FIG. 8 shows an example method of adaptively adjusting sensitivity of a sensor of a security system according to an embodiment of the disclosed subject matter.

FIG. 8 shows an example method 200 of adaptively adjusting sensitivity of a sensor of a security system according to an embodiment of the disclosed subject matter. At operation 210, a first sensor (e.g., sensors 71, 72 and/or 98) may detect a motion event of a door (e.g., door 150) or window (e.g., window 100) of a home or building. A controller (e.g., controller 73, device 20, and/or remote system 74 of FIG. 1 or the like) may determine whether the detected motion event is a human-caused motion event or a periodic motion event by comparing data of the detected motion event with stored motion data at operation 220. The controller may generate a security exception when the detected motion event is determined to be a periodic motion event at operation 230. The controller may adaptively adjust a sensitivity of the first sensor to detect the motion event according to data aggregated by the first sensor over a predetermined period of time. The period of time may be, for example, one hour, 12 hours, one day, one week, one month, six months, one year, and the like.

The method may include adjusting (e.g., by the controller 73 and/or by the sensors 72, 72) a first sensitivity level of the first sensor (e.g., sensors 71, 72, and/or 98) by comparing the first sensitivity level with a second sensitivity level of a second sensor. The first sensitivity level may be, for example, a calibrated value that has not been adjusted by aggregated data accumulated by the sensors 71, 72 over the predetermined period of time. The second sensitivity level may be from a sensor that may be monitoring a similar window, door, or the like, but may have been adjusted according to data aggregated for the predetermine period of time. When the first sensitivity level and the second sensitivity level are different from one another, the first sensitivity level can be adjusted to match the second sensitivity level.

In embodiments of the disclosed subject matter, the controller may refrain from outputting the control signal to an alarm device (e.g., alarm device 76) when the controller and/or the security system of the smart-home environment generates the security exception. Alternatively, or in addition, the controller and/or the security system of the smart-home environment may refrain from outputting a notification message to a device when the controller generates the security exception.

When the security exception is generated by the system, the system is halted and/or stopped from outputting an alarm and/or notification. That is, absent the generation of the security exception, the security system may output an alarm and/or a notification.

The security exception may be generated when the motion event is a period motion event. The periodic motion event may be periodic vibration, periodic noise, and the like. That is, periodic motion may be noise which is detected over a predetermined period of time, so as to have a pattern. For example, there may be periodic motion on a window that is from a nearby tree branch that contacts the window. In another example, vehicle traffic near a home or building may occur during 7 AM to LOAM and 4:30 PM to 7:00 PM, and thus may vibrate the window, which may be detected by the sensors 71, 72. By generating a security exception, unwanted alarms and notification messages may be reduced.

The first sensor may enter a calibration mode to detect signature data for the motion event, such as a door opening event, a door closing event, a window opening event, and/or a window closing event. That is, events such as the door opening event, a door closing event, a window opening event, and/or a window closing event may have particular data which are detected by the sensor which allows the controller to distinguish these events from other events, such as periodic noise and/or vibration. Alternatively, or in addition, the signature data for motion events may include multiple sets of signature data for each event where the signature data may be different for different occupants of the home or building. That is, one occupant may open, for example, a window with different force and/or acceleration characteristics than a second occupant of the same home.

The first sensor may transmit the detected signature data from the calibration mode to a second sensor communicatively coupled to the first sensor, the controller (e.g., controller 73, the device 20, and the like), and/or a remote server (e.g., remote system 74) communicatively coupled to the first sensor. The controller may output a control signal to control an operation of an alarm device (e.g., alarm device 76) or a notification message to a device (e.g., device 20) communicatively coupled to the controller when the data of the detected motion event is different from at least a portion of the signature data. The data of the detected motion event may be motion in a different axis, motion having a different rotation, and motion in a different direction.

In an embodiment of the disclosed subject matter, the controller may generate the security exception when the first sensor and a second sensor detect the motion event within a preset period of time. That is, when multiple sensors in a smart-home environment detect vibration, shaking, striking, and/or movement in the same period of time, the controller of the security system may determine that the event is not a security event where the controller should activate the alarm, and thus the system may generate the security exception.

The embodiments discussed above may be implemented in a security system of a smart-home environment shown in FIG. 1, and discussed in detail below. The security system and/or the smart-home environment may use one or more sensors to detection motion, vibration, noise, and the like, as well as detect other environmental information. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, entry, presence, pressure, light, sound, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an "armed" state (e.g., home mode, away mode, stay mode, vacation mode, etc.), or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

FIG. 1 shows an example of a smart-home environment and/or security system as disclosed herein, which may be implemented over any suitable wired and/or wireless communication networks. As discussed above, the security system of this smart home environment may determine whether there is motion, vibration, and or noise detected by a sensor of a door or window of a home or building, whether the detected motion is from a human or from another source, whether the door is being opened from the inside or outside according to the detected motion, and whether the motion is periodic. According to the detected sensor data, the system may generate a security exception to avoid unwanted alarms and/or notifications. The system may include network 70, sensors 71, 72, controller 73, remote system 74, alarm device 76, and device 20, and the like. That is, the sensors 71, 72, controller 73, remote system 74, alarm device 76, and device 20 may be communicatively coupled to one another via the network 70. As shown in FIG. 1, device 20 may be communicatively coupled to the sensor 72 and/or may be directly coupled to the network 70.

The sensors 71, 72 may communicate via the local network 70, such as a Wi-Fi or other suitable network, with each other and/or with the controller 73. The devices of the security system and smart-home environment of the disclosed subject matter (e.g., as shown in FIG. 1) may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensors 71, 72, which are generally described above, may detect movement of the user within a home or building. The data detected by the sensors 71, 72 may be aggregated to accurately determine an opening event of a door or window. In embodiments of the disclosed subject matter, the sensor 71, 72 may be a camera and/or motion sensor (e.g., which may include an accelerometer and/or electronic compass, or the like) to capture an image and/or movement of an occupant, which may be correlated with other data (e.g., vibration data, noise data, and the like) acquired from sensors 71, 72, to determine whether a window or door is being opened from inside of the home or building, or from the outside. For example, when the camera of sensors 71, 72 captures one or more images of an occupant and/or senses the motion of the occupant of the home near a window, and one or more sensors 71, 72 disposed near a window may determine an opening event, the controller 73 may determine the window opening event was initiated by the occupant, and the controller 73 controls the alarm device 76 to refrain from activating an alarm.

The sensors 71, 72 may distinguish between human-caused motion events and vibration (e.g., including movement) from other sources (e.g., a tree branch, rain, hail, ground vibration, sound waves, or the like). As discussed below, the sensors 71, 72 may be adaptive so as to automatically adjust the sensitivity of the detection. Detection data from the sensors 71, 72 may be aggregated so that the security system can distinguish between the human-caused motion events and vibration form other sources. From detected and/or aggregated data from the sensors 71, 72, signatures of events (e.g., opening a window or door, periodic vibration or noise, and the like) may be determined so that the security system may more accurately distinguish between human-caused motion events and vibration from other sources. The detected data from sensors 71, 72, the aggregated data, and the signatures of events may be stored, and vibration, shaking, striking, and/or moving data detected with the sensors 71, 72 may be compared with the stored signatures to determine whether the detected event is a security event, and whether the alarm device should be activated and/or a notification message should be transmitted. The sensors may detect periodic noise, and the system may generate a security exception when the aggregated periodic noise data is unrelated to a security event.

The controller 73 shown in FIG. 1 may be communicatively coupled to the network 70 may be and/or include a processor. Alternatively, or in addition, the controller 73 may be a general- or special-purpose computer. The controller 73 may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors 71, 72 may communicate directly with a remote system 74. The remote system 74 may, for example, aggregate data from multiple locations, provide instruction, software updates, and/or aggregated data to a controller 73 and/or sensors 71, 72.

The controller 73 may aggregate detection data from the sensors 71, 72 and store it in a storage device coupled to the controller 73 or the network 70. The data aggregated by the controller 73 may be used to determine entrance and exit patterns (e.g., what days and times users enter and exit from the house, what doors are used, and the like) of the members of the household, and the controller 73 may arm or disarm the alarm device 76 according to the determined patterns. Alternatively, or in addition, the controller 73 may aggregated data detected by the sensors 71, 72 so that the security system can distinguish between the human-caused motion events and motion events (e.g., vibration, noise, or the like) from other sources. As discussed in detail below, from the detected and/or aggregated data from the sensors 71, 72, the controller 73 may determine signatures of events (e.g., opening a window or door, periodic vibration or noise, and the like) so that the security system may more accurately distinguish between human-caused motion events and vibration from other sources.

The security system and/or smart-home environment shown in FIG. 1 includes the remote system 74. In embodiments of the disclosed subject matter, the remote system 74 may be a law enforcement provider system, a home security provider system, a medical provider system, and/or a fire department provider system. When a security event and/or environmental event is detected by at least one of one sensors 71, 72, a message may be transmitted to the remote system 74. The content of the message may be according to the type of security event and/or environmental event detected by the sensors 71, 72. For example, if smoke is detected by one of the sensors 71, 72, the controller 73 may transmit a message to the remote system 74 associated with a fire department to provide assistance with a smoke and/or fire event (e.g., request fire department response to the smoke and/or fire event). Alternatively, the sensors 71, 72 may generate and transmit the message to the remote system 74. In another example, when one of the sensors 71, 72 detects a security event, such a window or door of a building being compromised, a message may be transmitted to the remote system 74 associated with local law enforcement to provide assistance with the security event (e.g., request a police department response to the security event).

In embodiments of the disclosed subject matter, the remote system 74 may aggregated data detected by the sensors 71, 72 so that the security system can distinguish between the human-caused motion events and vibration form other sources. As discussed in detail throughout, from the detected and/or aggregated data from the sensors 71, 72, the remote system 74 may determine signatures of events so that the security system may more accurately distinguish between human-caused motion events and motion, vibration, and/or noise from other sources.

The security system as disclosed herein and shown in FIG. 1 may include an alarm device 76, which may include, for example, a light and an audio output device. The alarm device 76 may be controlled, for example, by controller 73. The light of the alarm device 76 may be activated so as to be turned on when one or more sensors 71, 72 detect a security event and/or an environmental event. Alternatively, or in addition, the light may be turned on and off in a pattern (e.g., where the light is turned on for one second, and off for one second; where the light is turned on for two seconds, and off for one second, and the like) when one or more sensors 71, 72 detect a security event and/or an environmental event. Alternatively, or in addition, an audio output device of the alarm device 76 may include at least a speaker to output an audible alarm when a security event and/or an environmental event is detected by the one or more sensors 71, 72.

In embodiments of the disclosed subject matter, the controller 73 may control the alarm device 76 to be activated (e.g., output an audio and/or visual alarm) when a security event is detected, such as an opening and/or forced entry of a door or window of a home or building is detected. The controller 73 may refrain from outputting a control signal to the alarm device 76 when a detected event by the sensors 71, 72 is determined to be associated with a motion of an occupant of the home or building (e.g., opening a window or door from the inside), and/or the motion and/or vibration is determined to be from another source (e.g., periodic noise that causes vibration, or the like).

As shown in FIG. 1, the device 20 may be communicatively coupled to the network 70 so as to exchange data, information, and/or messages with the sensors 71, 72, the controller 73, and the remote system 74. For example, the device 20 may receive notifications from the security system when an opening of a door or window occurs, the location of the door or window, the identity and/or image of the person opening the door or window, and/or when non-periodic motion, vibration, and/or noise occurs that is correlated with a security event.

Figure 3:
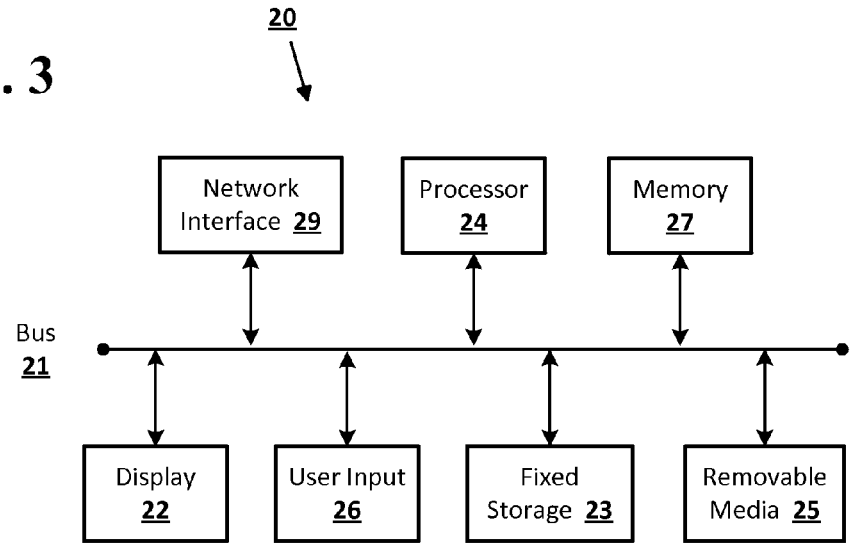
FIG. 3 shows a computing device according to an embodiment of the disclosed subject matter.

The security system of the disclosed subject matter, as shown in FIG. 1, may include a device 20 that may be communicatively coupled to a sensor. Although FIG. 1 illustrates that device 720 is coupled to sensor 72, the device 20 may be communicatively coupled to sensor 71 and/or sensor 72. The device 20 may be a computing device as shown in FIG. 3 and described below. A user of the security system disclosed herein may control the device 20. When the device 20 is within a predetermined distance (e.g., one foot, five feet, 10 feet, 20 feet, 100 feet, or the like) from the sensor 72, the device 20 and the sensor 72 may communicate with one another via Bluetooth signals, Bluetooth Low Energy (BTLE) signals, Wi-Fi pairing signals, near field communication (NFC) signals, radio frequency (RF) signals, infra-red signals, and/or short-range communication protocol signals. The device 20 may provide identifying information to the sensor 72, which may be provided to the controller 73 to determine whether the device 20 belongs to an authorized user of the security system disclosed herein. The controller 73 may monitor the location of the device 20 in order to determine whether to change an operating mode of the alarm device 76 (e.g., a home mode, a stay mode, and away mode, a vacation mode, or the like). The security system shown in FIG. 1 may detect the location of the device 20, and may correlate the detected motion of the device 20 (e.g., as being carried by an occupant of the home or building) with a detected event (e.g., an opening of a door or window, or the like) when the detected motion is within a predetermined area from the detected event. That is, the security system disclosed herein may use the detected location and/or motion of the device 20 to determine whether the detected event (e.g., the opening of the window or door, the detection of vibration and/or noise, or the like) is by an occupant (e.g., according to the movement of the occupant and/or the device 20, and the detection by the sensors 71, 72 from inside the home or building), or whether the detected event is from other motion and/or vibration (e.g., noise, periodic vibration, an outside intrusion event, or the like).

In some embodiments, when the sensor 72 and/or the controller 73 determine that the device 20 is associated with an authorized user according to the transmitted identification information, the sensor 72 and/or the controller 73 provide an operational status message to the user via a speaker (i.e., audio output 77), a display (e.g., where the display is coupled to the controller 73 and/or remote system 74), and/or the device 20. The operational status message displayed can include, for example, a message that a security event (e.g., a window or door has been opened) and/or environmental event has occurred. When the sensors 71, 72 have not detected a security and/or environmental event, a message may be displayed that no security and/or environmental event has occurred. In embodiments of the subject matter disclosed herein, the device 20 may display a source of the security event and/or environmental event, a type of the security event and/or environmental event, a time of the security event and/or environmental event, and a location of the security event and/or environmental event.

The sensor network shown in FIG. 1 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like). One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 1 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 1.

For example, a smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 1, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 1 and the controller 73 may control an alarm system to provide a visual and/or audible alarm to the user of the smart-home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 1 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIG. 1. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjusting the power and/or speed of the fan, accordingly. Smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, a smart-home environment may include one or more intelligent, multi-sensing, network-connected entry detectors (e.g., "smart entry detectors"). Such detectors may be or include one or more of the sensors 71, 72 shown in FIG. 1. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 1 can include one or more intelligent, multi-sensing, network-connected doorknobs (e.g., "smart doorknob"). For example, the sensors 71, 72 may be coupled to a doorknob of a door (e.g., at position 155 of door 150 shown in FIG. 6, and/or located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIG. 1 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, smart watch, wearable computing device, a tablet, radio frequency identification (RFID) tags, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device (e.g., device 20, as shown in FIGS. 1 and 3, and discussed in detail below). In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment may "learn" who is a user (e.g., an authorized user) and permit the electronic devices associated with those individuals to control the network-connected smart devices of the smart-home environment (e.g., devices communicatively coupled to the network 70), in some embodiments including sensors used by or within the smart-home environment. For example, as discussed above, the smart-home environment may learn "signatures" of motion (e.g., the amount and/or direction of force and/or motion that an occupant uses in opening a window, door, or the like), so as to be able to more accurately distinguish between occupant motion and/or vibration related to a door or window, periodic motion and/or vibration that is from another source, and motion and/or vibration from an intruder.

In the smart-home environment, various types of notices and other information may be provided to users via messages sent to one or more user electronic devices (e.g., device 20). For example, the messages can be sent via email, short message service (SMS), multimedia messaging service (MMS), unstructured supplementary service data (USSD), as well as any other type of messaging services and/or communication protocols.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

Figure 2:
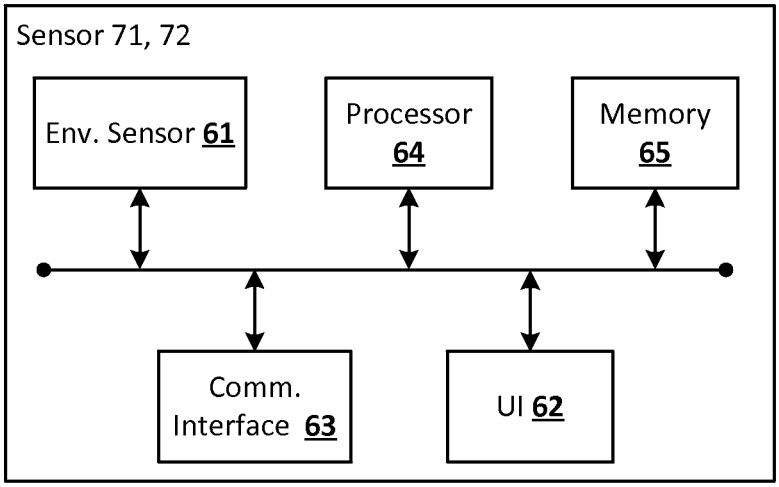
FIG. 2 shows an example sensor according to an embodiment of the disclosed subject matter.

The sensor 71, 72, as shown in FIG. 1, may include hardware in addition to the specific physical sensor that obtains information about the environment. FIG. 2 shows an example sensor as disclosed herein. The sensors 71, 72 may include an environmental sensor 61, such as a temperature sensor, smoke sensor, carbon monoxide sensor, motion sensor, accelerometer, electronic compass, proximity sensor, passive infrared (PIR) sensor, magnetic field sensor, radio frequency (RF) sensor, light sensor, humidity sensor, pressure sensor, microphone, or any other suitable environmental sensor, that obtains a corresponding type of information about the environment in which the sensors 71, 72 is located. A processor 64 may receive and analyze data obtained by the sensor 61, control operation of other components of the sensor 71, 72, and process communication between the sensor and other devices. The processor 64 may execute instructions stored on a computer-readable memory 65. The memory 65 or another memory in the sensor 71, 72 may also store environmental data obtained by the sensor 61. A communication interface 63, such as a Wi-Fi or other wireless interface, Ethernet or other local network interface, or the like may allow for communication by the sensors 71, 72 with other devices. A user interface (UI) 62 may provide information and/or receive input from a user of the sensor. The UI 62 may include, for example, a speaker to output an audible alarm when an event is detected by the sensors 71, 72. Alternatively, or in addition, the UI 62 may include a light to be activated when an event is detected by the sensors 71, 72. The user interface may be relatively minimal, such as a liquid crystal display (LCD), light-emitting diode (LED) display, or limited-output display, or it may be a full-featured interface such as a touchscreen. Components within the sensors 71, 72 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Embodiments of the presently disclosed subject matter may be implemented in and used with a variety of computing devices. FIG. 3 as an example computing device 20 suitable for implementing embodiments of the presently disclosed subject matter. The computing device may be the device 20 illustrated in FIG. 1 and discussed above. The device 20 may be used to implement a controller, a device including sensors as disclosed herein, or the like. Alternatively or in addition, the device 20 may be, for example, a desktop or laptop computer, or a mobile computing device such as a smart phone, tablet, key FOB, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen and/or lights (e.g., green, yellow, and red lights, such as light emitting diodes (LEDs) to provide the operational status of the security system to the user, as discussed above), a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide a communications link with the network 70, sensors 71, 72, controller 73, and/or the remote system 74 as illustrated in FIG. 1. The network interface 29 may provide such connection using any suitable technique and protocol as will be readily understood by one of skill in the art, including digital cellular telephone, radio frequency (RF), Wi-Fi, Bluetooth®, Bluetooth Low Energy (BTLE), near-field communications (NFC), and the like. For example, the network interface 29 may allow the device to communicate with other computers via one or more local, wide-area, or other communication networks, as described in further detail herein.

Figure 4:
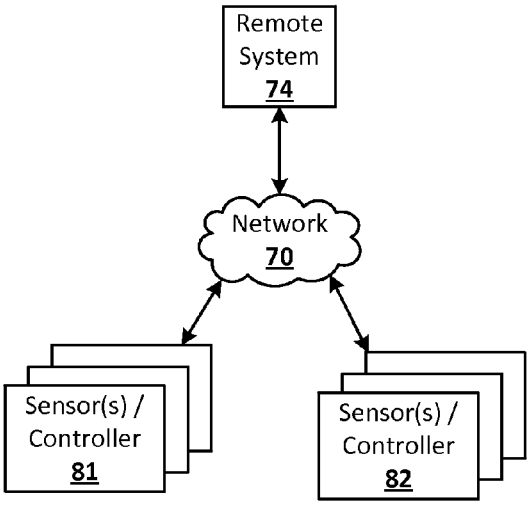
FIG. 4 shows a remote system to aggregate data from multiple locations having security systems according to an embodiment of the disclosed subject matter.

As shown in FIG. 4, a remote system 74 may aggregate data from multiple locations, such as multiple buildings, multi-resident buildings, individual residences within a neighborhood, multiple neighborhoods, and the like. In general, multiple sensor/controller systems 81, 82 as previously described with respect to FIG. 1 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

For example, the remote system 74 may aggregate data from sensors 71, 72 to determine whether data from the sensors 71, 72 may be classified as periodic motion and/or vibration data. The remote system 74 may create signatures and/or profiles for one or more events according to the aggregated data that is determined to be periodic motion, vibration, and/or noise. The remote system 74 may provide the created signatures and/or profiles to the multiple sensor/ controller systems 81, 82 so that the sensors of the controller systems 81, 82 may be adjusted so as to increase the accuracy of detection of periodic movement and/or vibration, and so that security exceptions may be accurately generated by the system so that the system refrains from outputting an alarm and/or notification message.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A system comprising:

a first sensor to detect a motion event of a door or window of a building, wherein the detected motion event includes a detected physical force; and a controller communicatively coupled to the first sensor, to determine whether the detected motion event is a human-caused motion event or a non-human periodic motion event by a comparison between data of the detected motion event, including the detected physical force, and stored motion data, and to generate a security exception when the detected motion event is determined to be the non-human periodic motion event that is determined by the comparison between the detected motion event and the stored motion data, wherein the controller adaptively adjusts a sensitivity of the first sensor to detect the motion event according to data aggregated by the first sensor over a predetermined period of time.

2. The system of claim 1, further comprising:

a second sensor communicatively coupled to the controller, wherein the controller adaptively adjusts a first sensitivity level of the first sensor by comparing the first sensitivity level with a second sensitivity level of the second sensor.

3. The system of claim 2, wherein, when the first sensitivity level and the second sensitivity level are different from one another, the first sensitivity level is adjusted to match the second sensitivity level.

4. The system of claim 1, wherein the first sensor comprises at least one from a group consisting of: an electronic compass, an accelerometer, and a reed switch.

5. The system of claim 1, wherein the controller refrains from outputting a control signal to an alarm device when the controller generates the security exception.

6. The system of claim 1, wherein the controller refrains from outputting a notification message to a device when the controller generates the security exception.

7. The system of claim 1, wherein the first sensor enters a calibration mode to detect signature data for the motion event selected from the group consisting of: a door opening event, a door closing event, a window opening event, and a window closing event.

8. The system of claim 7, wherein the detected signature data from the calibration mode is transmitted from the first sensor to at least one from the group consisting of: a second sensor communicatively coupled to the first sensor, the controller, and a remote server communicatively coupled to the sensor.

9. The system of claim 7, wherein, when the data of the detected motion event is different from at least a portion of the signature data, the controller outputs a control signal to control an operation of the alarm device or transmits a notification message to a device communicatively coupled to the controller.

10. The system of claim 9, wherein the data of the motion event is different from the at least a portion of the signature data according to one from a group consisting of: motion in a different axis, motion having a different rotation, and motion in a different direction.

11. The system of claim 1, further comprising:

a second sensor communicatively coupled to the first sensor in the building, wherein when the first sensor and the second sensor detect the motion event within a preset period of time, the controller generates the security exception.

12. The system of claim 1, further comprising:

a second sensor that detects the motion event, and is communicatively coupled to the first sensor and the controller, wherein the controller determines that the detected motion event is the non-human periodic motion event based on the motion event detected by the first sensor and the second sensor.

13. A method comprising:

detecting, by a first sensor, a motion event of a door or window of a building, wherein the detected motion event includes a detected physical force;

determining, by a controller communicatively coupled to the first sensor, whether the detected motion event is a human-caused motion event or a non-human periodic motion event by comparing data of the detected motion event, including the detected physical force, and stored motion data;

generating, by the controller, a security exception when the detected motion event is determined to be the non-human periodic motion event that is determined by the comparison between the detected motion event and the stored motion data; and adaptively adjusting, by the controller, a sensitivity of the first sensor to detect the motion event according to data aggregated by the first sensor over a predetermined period of time.

14. The method of claim 13, further comprising:

adjusting, by the controller, a first sensitivity level of the first sensor by comparing the first sensitivity level with a second sensitivity level of a second sensor.

15. The method of claim 14, further comprising:

when the first sensitivity level and the second sensitivity level are different from one another, adjusting the first sensitivity level to match the second sensitivity level.

16. The method of claim 13, further comprising:

refraining from outputting, by the controller, the control signal to an alarm device when the controller generates the security exception.

17. The method of claim 13, further comprising:

refraining from outputting, by the controller, a notification message to a device when the controller generates the security exception.

18. The method of claim 13, further comprising:

entering, by the first sensor, a calibration mode to detect signature data for the motion event selected from the group consisting of: a door opening event, a door closing event, a window opening event, and a window closing event.

19. The method of claim 18, further comprising:

transmitting, by the first sensor, the detected signature data from the calibration mode to at least one from the group consisting of: a second sensor communicatively coupled to the first sensor, the controller, and a remote server communicatively coupled to the first sensor.

20. The method of claim 18, further comprising:

outputting, by the controller, a control signal to control an operation of an alarm device or a notification message to a device communicatively coupled to the controller when the data of the detected motion event is different from at least a portion of the signature data.

21. The method of claim 20, wherein the data of the detected motion event is different from a group consisting of: motion in a different axis, motion having a different rotation, and motion in a different direction.

22. The method of claim 13, wherein the controller generates the security exception when the first sensor and a second sensor detect the motion event within a preset period of time.

23. The method of claim 13, wherein the determining that the detected motion event is the non-human period motion event based on the motion event detected by the first sensor and a second sensor.

* * * * *